US009221151B2

(12) United States Patent
Seth

(10) Patent No.: US 9,221,151 B2
(45) Date of Patent: Dec. 29, 2015

(54) ABRASIVE ARTICLES INCLUDING A BLEND OF ABRASIVE GRAINS AND METHOD OF FORMING SAME

(71) Applicants: Saint-Gobain Abrasives, Inc., Worcester, MA (US); Saint-Gobain Abrasifs, Conflans-Sainte-Honorine (FR)

(72) Inventor: Anuj Seth, Northborough, MA (US)

(73) Assignees: Saint-Gobain Abrasives, Inc., Worcester, MA (US); Saint-Gobain Abrasifs, Conflans-Sainte-Honorine (FR)

( * ) Notice: Subject to any disclaimer, the term of this patent is extended or adjusted under 35 U.S.C. 154(b) by 0 days.

(21) Appl. No.: 14/145,900

(22) Filed: Dec. 31, 2013

(65) Prior Publication Data

US 2014/0182213 A1 Jul. 3, 2014

Related U.S. Application Data

(60) Provisional application No. 61/747,848, filed on Dec. 31, 2012.

(51) Int. Cl.

| | |
|---|---|
| ***B24D 3/00*** | (2006.01) |
| ***B24D 3/02*** | (2006.01) |
| ***B24D 11/00*** | (2006.01) |
| ***B24D 18/00*** | (2006.01) |
| ***C09K 3/14*** | (2006.01) |

(52) U.S. Cl.
CPC ..... *B24D 3/001* (2013.01)

(58) Field of Classification Search
USPC ..... 51/298, 293, 307, 309
See application file for complete search history.

(56) References Cited

U.S. PATENT DOCUMENTS

| | | | | |
|---|---|---|---|---|
| 3,891,408 | A | 6/1975 | Rowse et al. | |
| 3,893,826 | A | 7/1975 | Quinan et al. | |
| RE31,620 | E | 7/1984 | Leahy | |
| 4,505,720 | A * | 3/1985 | Gabor | C09K 3/1436 427/217 |
| 4,543,107 | A | 9/1985 | Rue | |
| 4,623,364 | A | 11/1986 | Cottringer et al. | |
| 4,652,274 | A | 3/1987 | Boettcher et al. | |
| 4,734,104 | A * | 3/1988 | Broberg | B24D 11/04 51/295 |
| 4,737,163 | A | 4/1988 | Larkey | |
| 4,741,743 | A | 5/1988 | Narayanan et al. | |
| 4,836,832 | A | 6/1989 | Tumey et al. | |
| 5,007,943 | A | 4/1991 | Kelly et al. | |
| 5,011,512 | A | 4/1991 | Wald et al. | |

(Continued)

FOREIGN PATENT DOCUMENTS

| | | |
|---|---|---|
| EP | 0587171 A1 | 3/1994 |
| EP | 0592284 A2 | 4/1994 |

OTHER PUBLICATIONS

International Search Report from PCT/US2013/078561, dated Apr. 15, 2014, 1 pg.

(Continued)

*Primary Examiner* — James McDonough
(74) *Attorney, Agent, or Firm* — Joseph P. Sullivan; Abel Law Group, LLP

(57) ABSTRACT

An abrasive article comprising a backing material and an abrasive layer disposed on the backing material, wherein the abrasive layer comprises a blend of abrasive particles comprising a first plurality of abrasive particles and a second plurality of abrasive particles.

20 Claims, 2 Drawing Sheets

(56) References Cited

U.S. PATENT DOCUMENTS

| | | | |
|---|---|---|---|
| 5,037,452 | A | 8/1991 | Gary et al. |
| 5,108,463 | A | 4/1992 | Buchanan |
| 5,137,542 | A | 8/1992 | Buchanan et al. |
| 5,139,536 | A | 8/1992 | Haynes, Jr. |
| 5,185,012 | A | 2/1993 | Kelly |
| 5,213,591 | A | 5/1993 | Celikkaya et al. |
| 5,328,716 | A | 7/1994 | Buchanan |
| 5,417,726 | A | 5/1995 | Stout et al. |
| 5,454,750 | A | 10/1995 | Cosmano et al. |
| 5,474,583 | A | 12/1995 | Celikkaya |
| 5,505,747 | A | 4/1996 | Chesley et al. |
| 5,560,753 | A | 10/1996 | Schnabel et al. |
| 5,565,011 | A | 10/1996 | Follett et al. |
| 5,573,619 | A | 11/1996 | Benedict et al. |
| 5,584,896 | A | 12/1996 | Broberg et al. |
| 5,628,806 | A | 5/1997 | Celikkaya et al. |
| RE35,570 | E | 7/1997 | Rowenhorst et al. |
| 5,702,811 | A | 12/1997 | Ho et al. |
| 5,840,090 | A | 11/1998 | Ho et al. |
| 5,876,470 | A | 3/1999 | Abrahamson |
| 6,277,161 | B1 | 8/2001 | Castro et al. |
| 7,077,723 | B2 | 7/2006 | Bright et al. |
| 7,399,330 | B2 | 7/2008 | Schwabel et al. |
| 7,547,243 | B2 * | 6/2009 | Wiswesser ..... B24B 37/013 451/533 |
| 8,038,751 | B2 | 10/2011 | Starling |
| 8,287,611 | B2 | 10/2012 | You et al. |
| 2002/0160694 | A1 | 10/2002 | Wood et al. |
| 2005/0130568 | A1 | 6/2005 | Welygan et al. |
| 2006/0194038 | A1 | 8/2006 | You et al. |
| 2006/0207187 | A1 | 9/2006 | Gaeta et al. |
| 2008/0216414 | A1 * | 9/2008 | Braunschweig et al. ..... 51/298 |
| 2009/0041983 | A1 | 2/2009 | Gaeta et al. |
| 2009/0145044 | A1 * | 6/2009 | You ..... B24D 3/34 51/298 |
| 2009/0260297 | A1 | 10/2009 | Seth et al. |
| 2010/0319269 | A1 | 12/2010 | Erickson |
| 2010/0326894 | A1 * | 12/2010 | Palmgren ..... B07B 1/00 209/659 |
| 2012/0055096 | A1 | 3/2012 | Goldsmith et al. |
| 2012/0227333 | A1 | 9/2012 | Adefris et al. |
| 2012/0231711 | A1 | 9/2012 | Keipert et al. |

OTHER PUBLICATIONS

DuPont Packaging & Industrial Polymers—DuPont Surlyn 1652—Surlyn resins Product Data Sheet, E.I. du Pont de Nemours and Company, Inc., printed Dec. 15, 2010, 4 pages.

* cited by examiner

ABRASIVE ARTICLES INCLUDING A BLEND OF ABRASIVE GRAINS AND METHOD OF FORMING SAME

BACKGROUND

1. Field of the Disclosure

The following is generally directed to abrasive articles and methods of making same that include a blend of abrasive grains.

2. Description of the Related Art

Abrasive articles have been used to abrade and finish workpiece surfaces. Applications suitable for using abrasive articles include high stock removal from workpieces such as wood and metal, to fine polishing of ophthalmic lenses, fiber optics and computer read-write heads. In general, abrasive articles comprise a plurality of abrasive particles bonded either together (e.g., a bonded abrasive or grinding wheel) or to a backing (e.g., a coated abrasive article). For a coated abrasive article, there is typically a single layer, or sometimes a plurality of layers, of abrasive particles bonded to the backing. The abrasive particles can be bonded to the backing with a "make" coat and "size" coat, or as a slurry coat. Further, a supersize coat can be applied on the make coat or size coat to help extend the life of the abrasive particles.

Various configurations of abrasive articles are known, for example, wheels, discs, endless belts, sanding sponges, and the like. The configurations of the abrasive article will affect the intended use of the articles. For example, some abrasive articles are configured to be connected to a vacuum source during use, to remove dust and swarf from the abrading surface.

Generally, the performance of an abrasive article is affected by the abrasive particles that make up the abrasive surface or abrasive layer of the abrasive article. Although many types of abrasive surfaces and abrasive layers are known for use in abrasive articles, there is still a need in the art for improved abrasive surfaces and improved abrasive layers.

BRIEF DESCRIPTION OF THE DRAWINGS

The present disclosure can be better understood, and its numerous features and advantages made apparent to those skilled in the art by referencing the accompanying drawings

DETAILED DESCRIPTION

The following is directed to abrasive articles having a beneficial blend of abrasive particles, in particular, coated abrasive articles having a beneficial blend of abrasive particles, which can be useful in a wide variety of grinding and polishing applications, including, stock removal or polishing of coated or uncoated surfaces, such as wood, stone, metal, ceramic, plastics, glass, and composites. It has also been noted by applicants that beneficial blends of abrasive particles can produce improved abrasive performance when used in combination with certain backing materials.

The following description, in combination with the figures, is provided to assist in understanding the teachings disclosed herein. The following discussion will focus on specific implementations and embodiments of the teachings. This focus is provided to assist in describing the teachings and should not be interpreted as a limitation on the scope or applicability of the teachings.

Unless otherwise defined, all technical and scientific terms used herein have the same meaning as commonly understood by one of ordinary skill in the art to which this invention belongs. The materials, methods, and examples are illustrative only and not intended to be limiting. To the extent not described herein, many details regarding specific materials and processing procedures are conventional and can be found in textbooks and other sources within the coated abrasive arts.

Abrasive Article

In an embodiment, an abrasive article can be a coated abrasive article. An abrasive article can include backing material and an abrasive layer. A coated abrasive article can also include at least one of a size coat, a supersize coat, a back coat, a backsize coat, or any combination thereof.

Figure 1:
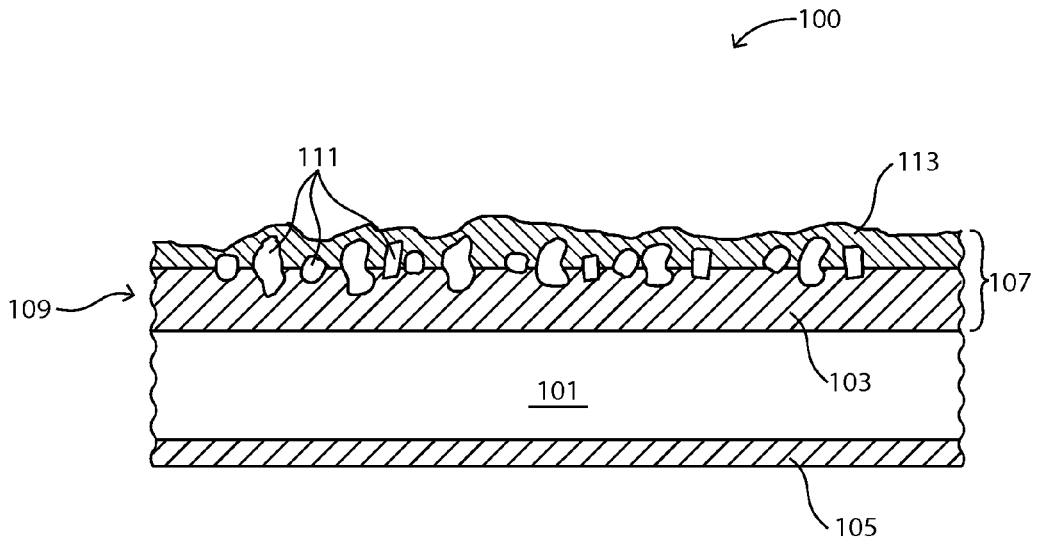
FIG. 1 is a schematic cross-sectional view of a coated abrasive article that includes an abrasive particle blend in accordance with an embodiment.
Figure 2:
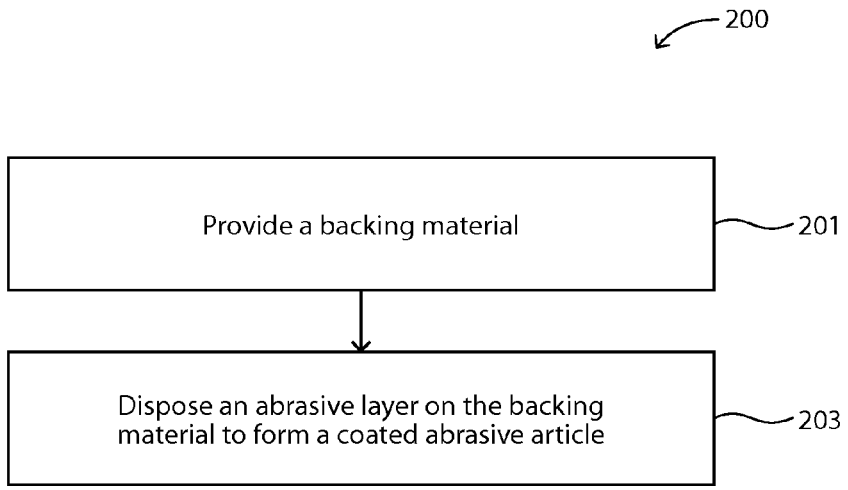
FIG. 2 is a process flow diagram for a method of forming a coated abrasive article that includes an abrasive particle blend in accordance with an embodiment.

FIG. 1 shows a side view of a coated abrasive article 100 including a backing material layer 101 having a first major surface 103 and a second major surface 105. As illustrated, the abrasive article 100 can include an abrasive layer 107 disposed on the first major surface 103 of the backing material layer 101. The abrasive layer can comprise multiple layers, including a binder layer 109, also called a make coat. As discussed further herein, a blend of abrasive particles 111 can be disposed on (such as resting upon, or penetrating into, or both) the binder layer, or dispersed within the binder layer, or combinations thereof. A size coat 113 can optionally be disposed on the binder layer. A supersize coat (not shown) can be disposed over the size coat. A back coat 115 can optionally be disposed on the second major surface (i.e., the back) of the backing material.

Backing Material

A backing material (also referred to herein as a support substrate) can comprise a single type of material or multiple types of material (a composite material). The backing material can comprise a single layer of a plurality of layers. In an embodiment, the backing material can comprise a composite backing material. In an embodiment, the composite backing material can comprise multiple layers.

A composite backing material can have a particular arrangement of layers. The particular arrangement of layers can influence the physical properties of the composite backing material. In turn, a composite backing material embodiment can influence the physical properties and abrasive performance of an abrasive article embodiment that includes the composite backing material. In some embodiments, composite backing materials include multiple layers and can be laminates of one or more backing materials, and can include a primer or an adhesive to hold the layers together. In other embodiments, a composite backing material can include one or more treatments for sealing the composite backing material, as a whole, or to seal one or more of the substituent layers of the composite backing material.

A backing material can be of any shape or conformation that is dictated by the intended use and materials of construction. In a particular embodiment, a backing material can be one of a sheet, a belt, a tape, a film, a roll, or a circular disc.

The backing material can be flexible or rigid. The backing can be made of any number of various materials including those conventionally used as backings in the manufacture of coated abrasives. An exemplary flexible backing includes a polymeric film (for example, a primed film), such as polyolefin film (e.g., polypropylene including biaxially oriented polypropylene), polyester film (e.g., polyethylene terephthalate), polyamide film, or cellulose ester film; metal foil; mesh; foam (e.g., natural sponge material or polyurethane foam); cloth (e.g., cloth made from fibers or yams comprising polyester, nylon, silk, cotton, poly-cotton or rayon); paper; vulcanized paper; vulcanized rubber; vulcanized fiber; nonwoven materials; a combination thereof; or a treated version thereof. Cloth backings may be woven or stitch bonded. In particular examples, the backing is selected from the group consisting of paper, polymer film, cloth, cotton, poly-cotton, rayon, polyester, poly-nylon, vulcanized rubber, vulcanized fiber, metal foil and a combination thereof. In other examples, the backing includes polypropylene film or polyethylene terephthalate (PET) film.

In a particular embodiment, the polymer film can be a primed film. Suitable primers can include a chemical primer that increases adhesion between the backing and the binder and/or between the backing layers. Suitable primers can include thermoplastic compositions or thermoset compositions. In a specific embodiment, a primer composition can comprise a polyurethane. In another embodiment, a chemical primer can comprise a polyethylene imine primer. A chemical primer can have a thickness of not greater than about 20 microns, such as not greater than 15 microns, not greater than 10 microns, 5 microns, such as not greater than about 3 microns, such as not greater than about 2.5 microns. In an embodiment, a chemical primer layer is not less than 0.1 microns.

In a particular embodiment, the backing can be a composite backing comprising a base layer, such a primed polymer film and a top layer of another polymer film or polymer composition. In a particular embodiment, a top layer can be a copolymer composition or an ionomer composition. In a particular embodiment, a top layer can comprise a thermoplastic ionomer film, such as an ethylene/methacrylic acid (E/MAA) copolymer.

An antistatic material can be included in a cloth backing material. The addition of an antistatic material can reduce the tendency of the coated abrasive article to accumulate static electricity when sanding wood or wood-like materials. Additional details regarding antistatic backings and backing treatments can be found in, for example, U.S. Pat. No. 5,108,463 (Buchanan et al.); U.S. Pat. No. 5,137,542 (Buchanan et al.); U.S. Pat. No. 5,328,716 (Buchanan); and U.S. Pat. No. 5,560,753 (Buchanan et al.), the disclosures of which are incorporated herein by reference.

The backing may be a fibrous reinforced thermoplastic such as described, for example, in U.S. Pat. No. 5,417,726 (Stout et al.), or an endless spliceless belt, as described, for example, in U.S. Pat. No. 5,573,619 (Benedict et al.), the disclosures of which are incorporated herein by reference. Likewise, the backing may be a polymeric substrate having hooking stems projecting therefrom such as that described, for example, in U.S. Pat. No. 5,505,747 (Chesley et al.), the disclosure of which is incorporated herein by reference. Similarly, the backing may be a loop fabric such as that described, for example, in U.S. Pat. No. 5,565,011 (Follett et al.), the disclosure of which is incorporated herein by reference.

According to another aspect, the backing material, including any individual layers, can have a particular thickness that facilitates the formation of a coated abrasive article having the features of the embodiments herein. For example, a backing can have an average total thickness in a range of 0.5 mils to 15 mils. In another embodiment, the backing material can have individual layers having a thickness in a range of 0.5 mils to 5 mils. For instance, in a particular embodiment the backing material can have a first layer having a thickness of about 3 mils and a second layer having a thickness of about 1 mil.

Adhesive Layers

The composite backing material can comprise an adhesive layer, such as a single adhesive layer, or multiple adhesive layers, such as a first adhesive layer and a second adhesive layer, or even additional adhesive layers. Where multiple adhesive layers are present the adhesive layers can be the same or different from each other.

In an embodiment, a composite backing material can include one or more adhesive layers. An adhesive layer can comprise an epoxy adhesive, an acrylic adhesive, a latex adhesive, a polyvinyl acetate adhesive, a silicone adhesive, a polyimide adhesive, a polyurethane adhesive, or combinations thereof.

Backing Surface Treatments

In an embodiment, the backing may be treated to improved adhesion between the binder and the backing. In an embodiment, the treatment may include surface treatment, chemical treatment, use of a primer, or any combination thereof. In an exemplary embodiment, the treatment may include corona treatment, UV treatment, electron beam treatment, flame treatment, scuffing, or any combination thereof.

In a particular embodiment, the backing material is subjected to corona treatment.

The treated backing material can have a desirable specific surface energy. In a specific embodiment, the backing material can have a surface energy of at least 45 dynes/cm$^2$, such as at least 46, at least 47, at least 48, at least 49, at least 50, at least 51, at least 52, or at least 53 dynes/cm$^2$. In an embodiment, the surface energy can be not greater than 75 dynes/cm$^2$, such as not greater than 70, not greater than 65, not greater than 60, or not greater than 55 75 dynes/cm$^2$.

Abrasive Layer

An abrasive layer can be formed from one or more coats and can include one or more plurality of abrasive grains. For example, an abrasive layer can include a make coat and can optionally include a size coat or a supersize coat. Abrasive layers generally include abrasive grains disposed on, embedded within, or dispersed with, the binder, or combinations thereof.

Abrasive Particles

The abrasive layer can include a layer of binder composition and abrasive particles (also referred to herein as abrasive grits or abrasive grains). The abrasive layer can include a make coat, an abrasive slurry, or a combination thereof. In an embodiment including a make coat, the abrasive particles can be disposed on the binder composition. In an embodiment including an abrasive slurry, the abrasive particles can be dispersed within the binder composition. It will be appreciated that a plurality of abrasive grains can be dispersed within, penetrating into, or resting upon the binder layer, or combinations thereof.

The abrasive grains can include essentially single phase inorganic materials, such as alumina, silicon carbide, silica, ceria, and harder, high performance superabrasive grains such as cubic boron nitride and diamond. Additionally, the abrasive grains can include composite particulate materials. Such materials can include aggregates, which can be formed through slurry processing pathways that include removal of the liquid carrier through volatilization or evaporation, leaving behind green aggregates, optionally followed by high temperature treatment (i.e., firing) to form usable, fired aggregates. Further, the abrasive regions can include engineered abrasives including macrostructures and particular three-dimensional structures.

In an embodiment, the abrasive grains are blended with the binder formulation to form abrasive slurry. Alternatively, the abrasive grains can be applied over the binder formulation after the binder formulation is coated on the backing. Optionally, a functional powder may be applied over the abrasive regions to prevent the abrasive regions from sticking to a patterning tooling. Alternatively, patterns may be formed in the abrasive regions absent the functional powder.

The abrasive grains may be formed of any one of or a combination of abrasive grains, including silica, alumina (fused or sintered), zirconia, zirconia/alumina oxides, silicon carbide, garnet, diamond, cubic boron nitride, silicon nitride, ceria, titanium dioxide, titanium diboride, boron carbide, tin oxide, tungsten carbide, titanium carbide, iron oxide, chromia, flint, emery. For example, the abrasive grains may be selected from a group consisting of silica, alumina, zirconia, silicon carbide, silicon nitride, boron nitride, garnet, diamond, co-fused alumina zirconia, ceria, titanium diboride, boron carbide, flint, emery, alumina nitride, and a blend thereof. Particular embodiments have been created by use of dense abrasive grains comprised principally of alpha-alumina.

In a specific embodiment, the abrasive particles comprise a semi-friable aluminum oxide, such as a blue fired heat treated semi-friable aluminum oxide ("BFRPL"); an example of which is BFRPL high temperature treated, calcined, angular grain shape commercially available from Treibacher, Vallach Austria, under the trade designation Alodur BFRPL.

In a specific embodiment, the abrasive particles comprise seeded-gel ("SG") alumina abrasive particles. Seeded gel alumina abrasive particles are ceramic aluminum oxide particles manufactured by a sintering process and which have a very fine microstructure. Each abrasive grit consists of submicron size sub-particles (micro to nano sized primary particles of alumina) which under grinding force are separated off from the larger secondary aluminum oxide abrasive particle (i.e., the grit sized aluminum oxide abrasive particle). Seeded-gel abrasive particles tend to stay sharper than conventional abrasives, which can dull as flats are worn on the working points of the abrasive grits.

In a specific embodiment, the abrasive particles comprise silicon carbide abrasive particles. Suitable silicon carbide particle can be any known silicon carbide particle such as black silicon carbide, green silicon carbide, or come combination thereof.

In a specific embodiment, the abrasive particles are a blend of abrasive particles, such as a blend of semi-friable aluminum oxide, seeded-gel aluminum oxide, silicon carbide, and combinations thereof. In a particular embodiment, the abrasive grain comprises a blend of seeded-gel aluminum oxide, semi-friable aluminum oxide, and silicon carbide in particular ratios, as described in greater detail herein.

The abrasive grain may also have a particular shape. An example of such a shape includes a rod, a triangle, a pyramid, a cone, a solid sphere, a hollow sphere, or the like. Alternatively, the abrasive grain may be randomly shaped.

In an embodiment, the abrasive grains can have an average grain size not greater than 1500 microns, such as not greater than about 1000 microns, not greater than 500 microns, not greater than 200 microns, or not greater than 100 microns. In another embodiment, the abrasive grain size is at least 5 microns, such as at least 10 microns, at least 15 microns, at least 20 microns, at least 250 microns, at least 50 microns, at least 100 microns, at least 200 microns, at least 500 microns, or even at least 1000 microns. It will be appreciated that the abrasive grains can have an average grain size within a range of any maximum or minimum value described herein. For example, in a particular embodiment, the abrasive grains size is from about 25 microns to about 1500 microns, such as about 50 microns to about 1500 microns. The grain size of the abrasive grains is typically specified to be the longest dimension of the abrasive grain. Generally, there is a range distribution of grain sizes. In some instances, the grain size distribution is tightly controlled.

The total number of pluralities of abrasive grains in abrasive blends of the present disclosure is not particular limited, and can include up to "n" pluralities of abrasive grains. For example, embodiments of the present disclosure include abrasive blends having at least two pluralities of abrasive grains, such as at least three pluralities of abrasive grains, at least four pluralities of abrasive grains, at least five pluralities of abrasive grains, at least six pluralities of abrasive grains, at least seven pluralities of abrasive grains or . . . at least "n" pluralities of abrasive grains.

In abrasive blend embodiments, at least one of the pluralities of abrasive grains may be selected from group consisting of blue fired heat treated semi-friable aluminum oxide, semi-friable aluminum oxide, seeded-gel aluminum oxide, silicon carbide, garnet, cubic boron nitride, diamond, superabrasives, sintered sol-gel alumina, aluminum oxide and alloys of aluminum oxide, agglomerates of abrasive grains and/or abrasive particles, aggregates of abrasive grains and/or abrasive particles, and mixtures thereof. For the remaining pluralities of abrasive grains in abrasive blend embodiments of the present disclosure, the remaining pluralities of abrasive grains may be selected from the group consisting of, silicon carbide, garnet, cubic boron nitride, diamond, superabrasives, agglomerates of abrasive grains and/or abrasive particles, aggregates of abrasive grains and/or abrasive particles, and mixtures thereof.

In abrasive blend embodiments having two pluralities of abrasive grains, the abrasive grains, agglomerates of abrasive grains and/or abrasive particles, and aggregates of abrasive grains and/or abrasive particles included therein may be different from each other. In abrasive blend embodiments having three pluralities of abrasive grains, all three of the pluralities of abrasive grains may each be different from one another, or at least two of the three pluralities of abrasive grains may be different from each other. In abrasive blend embodiments having four pluralities of abrasive grains, and one and up to all four of the pluralities of abrasive grains may each be different from one another.

In abrasive blend embodiments having five pluralities of abrasive grains, and one and up to all five of the pluralities of abrasive grains may each be different from one another, such as at least two of the five pluralities of abrasive grains may be different from each other, such as at least three of the five pluralities of abrasive grains may be different from each other, or at least four of the five pluralities of abrasive grains may be different from each other. This applies for embodiments of the present disclosure having up to "n" pluralities of abrasive grains, where "n" is defined as one of a set of positive integer values greater than zero.

As an example, one embodiments of the present disclosure may include a first plurality of abrasive grains including silicon carbide, and a second plurality of abrasive grains including seeded-gel aluminum oxide. Such an embodiment may also include a supersize layer comprising stearate.

In embodiments having at least two pluralities of abrasive grains, the first plurality of abrasive grains may be present in an amount of up to approximately 99% by weight (or 99 wt. %), based on a total weight of the abrasive blend, such as up to approximately 98% by weight, up to approximately 96% by weight, up to approximately 94% by weight, up to approximately 92% by weight, up to approximately 90% by weight, up to approximately 88% by weight, up to approximately 86% by weight, up to approximately 84% by weight, up to approximately 82% by weight, up to approximately 80% by weight, up to approximately 78% by weight, up to approximately 76% by weight, up to approximately 74% by weight, up to approximately 72% by weight, up to approximately 70% by weight, up to approximately 68% by weight, up to approximately 66% by weight, up to approximately 64% by weight, up to approximately 62% by weight, or up to approximately 60% by weight, based on a total weight of the abrasive blend.

In terms of lower limits, in embodiments having at least two pluralities of abrasive grains, the first plurality of abrasive grains may be present in an amount of at least approximately 5% by weight, based on a total weight of the abrasive blend, such as at least approximately 8% by weight, at least approximately 10% by weight, at least approximately 12% by weight, at least approximately 15% by weight, at least approximately 18% by weight, at least approximately 20% by weight, at least approximately 22% by weight, at least approximately 25% by weight, at least approximately 27% by weight, at least approximately 30% by weight, at least approximately 32% by weight, at least approximately 35% by weight, at least approximately 37% by weight, at least approximately 40% by weight, at least approximately 42% by weight, at least approximately 45% by weight, at least approximately 47% by weight, at least approximately 50% by weight, at least approximately 52% by weight, at least approximately 55% by weight, or at least approximately 60% by weight, based on a total weight of the abrasive blend.

In embodiments having at least two pluralities of abrasive grains, the second plurality of abrasive grains may be present in an amount of at least approximately 1% by weight, based on a total weight of the abrasive blend, such as at least approximately 5% by weight, at least approximately 10% by weight, at least approximately 15% by weight, at least approximately 20% by weight, at least approximately 25% by weight, at least approximately 30% by weight, at least approximately 35% by weight, at least approximately 40% by weight, or at least approximately 45% by weight, based on a total weight of the abrasive blend.

In terms of upper limits, in embodiments having at least two pluralities of abrasive brains, the second plurality of abrasive grains may be present in an amount of up to approximately 90% by weight, based on a total weight of the abrasive blend, such as up to approximately 85% by weight, up to approximately 80% by weight, up to approximately 75% by weight, up to approximately 70% by weight, up to approximately 65% by weight, up to approximately 60% by weight, up to approximately 55% by weight, up to approximately 50% by weight, or up to approximately 45% by weight, based on a total weight of the abrasive blend.

In embodiments, the abrasive blend may have a weighted average density of not more than about 4.75 g/cm$^3$, such as not more than about 4.7 g/cm$^3$, not more than about 4.6 g/cm$^3$, not more than about 4.5 g/cm$^3$, not more than about 4.4 g/cm$^3$, not more than about 4.3 g/cm$^3$, not more than about 4.2 g/cm$^3$, not more than about 4.1 g/cm$^3$, not more than about 4.0 g/cm$^3$, not more than about 3.9 g/cm$^3$, not more than about 3.8 g/cm$^3$, not more than about 3.7 g/cm$^3$, not more than about 3.6 g/cm$^3$, or not more than about 3.5 g/cm$^3$.

It will be understood that by "weighted average density," in the context of abrasive blends of the present disclosure, the density of each type of grain in the pluralities of abrasive grains is first calculated. Then, each density is assigned a weight based on its percentage in the total abrasive blend. The sum of the densities of each type of grain multiplied by its respective weight gives to final weighted average density for an abrasive grain blend or abrasive blend.

For example, to calculate the "weighted average density" of an abrasive blend according to the present disclosure:

$$WD=\{(W_1/W_t)*(GD_1)+(W_2/W_t)(GD_2)+\ldots(W_n)(W_t)*(GD_n)\}$$

where:

WD=weighted average density of an abrasive blend $W_n$=total weight of grain type n in the abrasive blend $W_t$=total weight of the abrasive blend $GD_n$=grain density of grain type n In terms of lower limits, the abrasive blend may have a weighted average density of at least about 2.5 g/cm$^3$, such as at least about 2.75 g/cm$^3$, at least about 2.85 g/cm$^3$, at least about 3.0 g/cm$^3$, at least about 3.15 g/cm$^3$, at least about 3.2 g/cm$^3$, at least about 3.3 g/cm$^3$, at least about 3.4 g/cm$^3$, at least about 3.5 g/cm$^3$, at least about 3.6 g/cm$^3$, at least about 3.65 g/cm$^3$, at least about 3.7 g/cm$^3$, at least about 3.75 g/cm$^3$, or at least about 3.8 g/cm$^3$.

In embodiments, the abrasive blend may have a weighted average Moh's hardness of at least about 6, such as at least about 6.2, at least about 6.3, at least about 6.4, at least about 6.5, at least about 6.6, at least about 6.8, at least about 6.9, at least about 7.0, at least about 7.10, at least about 7.15, at least about 7.25, at least about 7.35, at least about 7.45, at least about 7.5, at least about 7.6, at least about 7.7, at least about 7.8, at least about 7.9, or at least about 8.0.

In term of upper limits, in embodiments, the abrasive blend may have a weighted average Moh's hardness of less than about 10, such as less than about 9.9, less than about 9.8, less than about 9.7, less than about 9.6, less than about 9.5, less than about 9.4, less than about 9.3, less than about 9.2, less than about 9.1, less than about 9, less than about 8.9, less than about 8.8, less than about 8.75, less than about 8.6, less than about 8.5, less than about 8.4, or less than about 8.3.

It will be understood that "weighted average Moh's hardness" values, in the context of abrasive blends of the present disclosure, are calculated in a similar fashion to the "weighted average density," as described above, with the exception that instead of density values, Moh's hardness values for each type of grain are used. Accordingly, for succinctness and improved readability, the description of calculating "weighted average density" will not be repeated herein, and is incorporated by reference in its entirety with respect to "weighted average Moh's hardness."

In embodiments, for another method of measuring hardness, the abrasive blend may have a weighted average Knoop hardness value of at least about 1000, such at least about 1550, at least about 1600, at least about 1625, at least about 1650, at least about 1700, at least about 1750, at least about 1800, at least about 1850, at least about 1900, at least about 2000, at least about 2100, at least about 2250, at least about 2300, at least about 2400, at least about 2500, at least about 2600, at least about 2700, at least about 2800, at least about 2900, at least about 3000, at least about 3100, at least about 3250, at least about 3300, at least about 3400, at least about 3500, at least about 3600, at least about 3750, at least about 3800, at least about 3900, at least about 4000, at least about 4100, at least about 4200, at least about 4300, at least about 4400, at least about 4500, at least about 4600, at least about 4750, at least about 4900, at least about 5000, at least about 5100, at least about 5200, at least about 5300, at least about 5400, at least about 5500, at least about 5700, or at least about 6000.

It will be understood that "weighted average Knoop hardness" values, in the context of abrasive blends of the present disclosure, are calculated in a similar fashion to the "weighted average density," as described above, with the exception that instead of density values, Knoop hardness values for each type of grain are used. Accordingly, for succinctness and improved readability, the description of calculating "weighted average density" will not be repeated herein, and is incorporated by reference in its entirety with respect to "weighted average Knoop hardness."

In terms of upper limits, the abrasive blend may have a weighted average Knoop hardness value of less than about 8000, such at less than about 7900, less than about 7800, less than about 7700, less than about 7600, less than about 7500, less than about 7400, less than about 7300, less than about 7200, less than about 7100, less than about 7000, less than about 6900, less than about 6800, less than about 6700, less than about 6600, less than about 6500, less than about 6400, less than about 6300, less than about 6200, less than about 6250, less than about 6100, less than about 6000, less than about 5900, less than about 5800, less than about 5750, less than about 5600, less than about 5500, less than about 5400, less than about 5300, or less than about 5250.

Abrasive blend embodiments of the present disclosure may also be defined by various ratios or ratio relationships the pluralities of abrasive grains, within each abrasive blend. In particular, the ratios of grains for abrasive blends described herein, whether comprising two, three, four, five, six, seven, or . . . "n" pluralities of abrasive grains is not particularly limited. For example, for abrasive blends having two pluralities of abrasive grains, the ratio of the amount of the first plurality of abrasive grains to the second plurality of abrasive grains can be written as: x:y, where x represents the amount of the first plurality of abrasive grains in the blend; y represents the amount of the second plurality of abrasive grains in the blend; and x and y are defined within a set of any positive integer value greater than zero. For abrasive blends having three pluralities of abrasive grains, the ratio of the amount of the first plurality of abrasive grains to the second and the third pluralities of abrasive grains can be written as: x:y:z, where x represents the amount of the first plurality of abrasive grains in the blend; y represents the amount of the second plurality of abrasive grains in the blend; z represents the amount of the third plurality of abrasive grains in the blend; and x, y and z are defined within a set of any positive integer value greater than zero. The same can be repeated for up to "n" plurality of abrasive grains.

In abrasive blend ratios of the present disclosure, x, y, z . . . n, as described above, can be any one of a set of positive integer values greater than zero. In certain embodiments, x, y, z . . . n can all be different values. In other embodiments, any one and up to all x, y and z . . . n can be identical values.

For example, in embodiments where the abrasive blend comprises two pluralities of abrasive grains, such as a first plurality of abrasive grains and a second plurality of abrasive grains, the abrasive blend may comprise a grain ratio between the first plurality of abrasive grains and the second plurality of abrasive grains ranging from 1:10, such as from 1:9, from 1:8, from 1:7, from 1:6, from 1:5, from 1:4, from 1:3, 1:2; or from 1:1, and vice versa with respect to a grain ratio between the second plurality of abrasive grains and the first plurality of abrasive grains for each of the aforementioned ratio values.

In certain embodiments where the abrasive blend comprises two pluralities of abrasive grains, the abrasive blend may comprise a grain ratio between the first plurality of abrasive grains and the second plurality of abrasive grains of 2:3, or 2:5, or 2:7, or 2:9; and vice versa with respect to a grain ratio between the second plurality of abrasive grains and the first plurality of abrasive grains for each of the aforementioned ratio values.

In embodiments where the abrasive blend comprises three pluralities of abrasive grains, the abrasive blend may comprise a grain ratio between the first plurality of abrasive grains and the second plurality of abrasive grains ranging from 1:10, such as from 1:9, from 1:8, from 1:7, from 1:6, from 1:5, from 1:4, from 1:3, 1:2; or from 1:1 and vice versa with respect to a grain ratio between the second plurality of abrasive grains and the first plurality of abrasive grains for each of the aforementioned ratio values.

In certain embodiments where the abrasive blend comprises three pluralities of abrasive grains, the abrasive blend may comprise a grain ratio between the first plurality of abrasive grains and the second plurality of abrasive grains of 2:3, or 2:5, or 2:7, or 2:9; and vice versa with respect to a grain ratio between the second plurality of abrasive grains and the first plurality of abrasive grains for each of the aforementioned ratio values.

In certain embodiments where the abrasive blend comprises three pluralities of abrasive grains, the abrasive blend may comprise a grain ratio between the first plurality of abrasive grains, the second plurality of abrasive grains, and the third plurality of abrasive grains of from 1:5:10, and all values between, such as from 1:5:9, from 1:5:8, from 1:5:7, from 1:2:10, from 1:3:10, from 1:4:10, from 2:5:10 from 2:5:9, from 2:4:8, from 2:4:7, from 2:5:7, from 3:5:10, from 3:5:9, from 3:5:7, from 3:5:7, from 3:5:5, from 1:3:3, from 1:2:3, from 1:1:10, from 1:1:5, from 1:1:2, from 1:1:1, or from 2:2:5.

In particular embodiments where the abrasive blend comprises three pluralities of abrasive grains, the abrasive blend may comprise a grain ratio between the first plurality of abrasive grains, the second plurality of abrasive grains, and the third plurality of abrasive grains of 2:3:3.

In embodiments where the abrasive blend comprises two or more pluralities of abrasive grains, the first plurality of abrasive grains (this may apply for two, three, four or five plurality of abrasive grain blends) may be present in an amount that is at least twice the amount of the second abrasive grain in the abrasive grain blend. Alternatively, in the first abrasive grain and the second abrasive grain may be present in equal amounts in the abrasive blend.

In embodiments where the abrasive blend comprises three or more pluralities of abrasive grains, the second plurality of abrasive grains may be present in an amount that is at least twice the amount of the third plurality of abrasive grains in the abrasive blend. Alternatively, the first plurality of abrasive grains, the second plurality of abrasive grains and the third plurality of abrasive grains may be present in equal amounts in the abrasive blend.

In embodiments where the abrasive blend comprises three or more pluralities of abrasive grains, the third plurality of abrasive grains may be present in an amount that is at least twice the amount of the plurality of first abrasive grains.

In abrasive blend embodiments, the second plurality of abrasive grains may be present in an amount of no greater than ten times the amount of the first plurality of abrasive grains, and vice versa between the first plurality of abrasive grains and the second plurality of abrasive grains. Moreover, in embodiments where the abrasive blend comprises three or more pluralities of abrasive grains, the first plurality of abrasive grains is present in an amount of no greater than ten times the amount of the third plurality of abrasive grains, and vice versa between the first plurality of abrasive grains and the third plurality of abrasive grains.

It will be appreciated that the grain ratios (whether with respect to the first plurality of abrasive grains and the second plurality of abrasive grains; the second plurality of abrasive grains with respect to the third plurality of abrasive grains; the first plurality of abrasive grains with respect to the third plurality of abrasive grains; the first plurality of abrasive grains with respect to the second and third plurality of abrasive grains; or the first plurality of abrasive grains with respect to the second and fourth plurality of abrasive grains, and the like) is not particularly limiting and the above described ratios and amounts are intended to encompass all vice versa scenarios, and all range amounts between the ratios and/or amounts described above; and may also be applied to different combinations of first, second, third, fourth and/or fifth plurality of abrasive grains, and any combinations or multiple ratios thereof, not specifically listed herein.

It will be appreciated that the above-described grain ratios and amounts of grains with respect to other grains in a grain blend are not intended to be limiting, and that the above-described illustrative ratios and amounts are intended to include all reverse ratios as well.

Make Coat—Binder

The binder of the make coat or the size coat may be formed of a single polymer or a blend of polymers. For example, the binder may be formed from epoxy, acrylic polymer, or a combination thereof. In addition, the binder may include filler, such as nano-sized filler or a combination of nano-sized filler and micron-sized filler. In a particular embodiment, the binder is a colloidal binder, wherein the formulation that is cured to form the binder is a colloidal suspension including particulate filler. Alternatively, or in addition, the binder may be a nanocomposite binder including sub-micron particulate filler.

The binder generally includes a polymer matrix, which binds abrasive grains to the backing or compliant coat, if present. Typically, the binder is formed of cured binder formulation. In one exemplary embodiment, the binder formulation includes a polymer component and a dispersed phase.

The binder formulation may include one or more reaction constituents or polymer constituents for the preparation of a polymer. A polymer constituent may include a monomeric molecule, a polymeric molecule, or a combination thereof. The binder formulation may further comprise components selected from the group consisting of solvents, plasticizers, chain transfer agents, catalysts, stabilizers, dispersants, curing agents, reaction mediators and agents for influencing the fluidity of the dispersion.

The polymer constituents can form thermoplastics or thermosets. By way of example, the polymer constituents may include monomers and resins for the formation of polyurethane, polyurea, polymerized epoxy, polyester, polyimide, polysiloxanes (silicones), polymerized alkyd, styrene-butadiene rubber, acrylonitrile-butadiene rubber, polybutadiene, or, in general, reactive resins for the production of thermoset polymers. Another example includes an acrylate or a methacrylate polymer constituent. The precursor polymer constituents are typically curable organic material (i.e., a polymer monomer or material capable of polymerizing or crosslinking upon exposure to heat or other sources of energy, such as electron beam, ultraviolet light, visible light, etc., or with time upon the addition of a chemical catalyst, moisture, or other agent which cause the polymer to cure or polymerize). A precursor polymer constituent example includes a reactive constituent for the formation of an amino polymer or an aminoplast polymer, such as alkylated urea-formaldehyde polymer, melamine-formaldehyde polymer, and alkylated benzoguanamine-formaldehyde polymer; acrylate polymer including acrylate and methacrylate polymer, alkyl acrylate, acrylated epoxy, acrylated urethane, acrylated polyester, acrylated polyether, vinyl ether, acrylated oil, or acrylated silicone; alkyd polymer such as urethane alkyd polymer; polyester polymer; reactive urethane polymer; phenolic polymer such as resole and novolac polymer; phenolic/latex polymer; epoxy polymer such as bisphenol epoxy polymer; isocyanate; isocyanurate; polysiloxane polymer including alkylalkoxysilane polymer; or reactive vinyl polymer. The binder formulation may include a monomer, an oligomer, a polymer, or a combination thereof. In a particular embodiment, the binder formulation includes monomers of at least two types of polymers that when cured may crosslink. For example, the binder formulation may include epoxy constituents and acrylic constituents that when cured form an epoxy/acrylic polymer.

In an embodiment the binder composition can optionally comprise a mineral filler, such as wollastonite. The mineral filler can be included in an amount less than 29%, less than 25%, less than 20%, less than 15%, or less than 10% by weight of the binder composition. In an embodiment, the binder composition can free of filler (0 wt % filler). In another embodiment, the binder can contain from about 1 wt % to about 19 wt % mineral filler.

Diluents

It will be appreciated to one of ordinary skill that the abrasive grains contained within the pluralities of abrasive grains in embodiments of the present disclosure, as described above, should not be confused with "diluents" (also called diluent grains or diluent particles) which can comprise any one of: active fillers, inactive fillers, organic fillers and/or inorganic fillers, and combinations thereof. Nevertheless, such diluent compounds, including active fillers, inactive fillers, organic fillers and/or inorganic fillers, can optionally be present in the abrasive blends of the present disclosure. Such diluents can also be present in the overall system of coated abrasives such as in make, size, resin or supersize coats, in addition to the grain layer. The amounts of diluent materials can be selected to provide the properties desired.

Examples of suitable lubricants include lithium stearate. Examples of suitable anti-static agent include alkali metal sulfonates, tertiary amines and the like. Examples of suitable anti-loading agents include metal salts of fatty acids, for example, zinc stearate, calcium stearate and lithium stearate, sodium laurel sulfate and the like. Anionic organic surfactants can also be used effective anti-loading agents.

Additives—Grinding Aid

The abrasive layer may further include a grinding aid to increase the grinding efficiency and cut rate. A useful grinding aid can be inorganic based, such as a halide salt, for example, sodium cryolite, and potassium tetrafluoroborate; or organic based, such as a chlorinated wax, for example, polyvinyl chloride. A particular embodiment includes cryolite and potassium tetrafluoroborate with particle size ranging from 1 micron to 80 microns, and most typically from 5 microns to 30 microns. The supersize coat can be a polymer layer applied over the abrasive grains to provide anti-glazing and anti-loading properties.

Back Coat—Compliant Coat

The coated abrasive article may optionally include compliant and back coats (not shown). These coats may function as described above and may be formed of binder compositions.

Method of Making—Coated Abrasive Article

An abrasive article according to embodiments herein can be formed by any method known in the art. For example a method of forming an abrasive article with the composite backing material can include disposing an abrasive layer on a composite backing material according to any embodiment herein. The abrasive layer may be formed from one or more coats and a plurality of abrasive grains. For example, the abrasive layer can include a make coat and can optionally include a size coat or a supersize coat. Abrasive layers generally include abrasive grains disposed on, embedded within, dispersed within, or combinations thereof, in a binder.

In accordance with an embodiment for making a coated abrasive article having a composite backing material layer according to embodiments described herein, a backing can be distributed from a roll, the backing can be coated with a binder formulation dispensed from a coating apparatus. An exemplary coating apparatus includes a drop die coater, a knife coater, a curtain coater, a vacuum die coater or a die coater. Coating methodologies can include either contact or non-contact methods. Such methods include two roll, three roll reverse, knife over roll, slot die, gravure, rotary printing, extrusion, spray coating applications, or combinations thereof.

In an embodiment, the binder formulation can be provided in a slurry including the formulation and abrasive grains. In an alternative embodiment, the binder formulation can be dispensed separate from the abrasive grains. The abrasive grains may be provided following coating of the backing with the binder, after partial curing of the binder formulation, after patterning of the binder formulation, if any, or after fully curing the binder formulation. The abrasive grains may, for example, be applied by a technique, such as electrostatic coating, drop coating, or mechanical projection.

The abrasive grains can be prepared as a blend of abrasive grains in any desired amounts or ratios and applied in a single pass. Alternatively, the abrasive grains can be applied in separate passes, wherein the amounts applied during each pass corresponds to a desired amounts or ratio with respect to the other abrasive grains.

In another embodiment, the backing, coated with the binder and abrasive grains, can be stamped, die-cut, laser cut, or combinations thereof to form the shape of the coated abrasive (e.g., round disc) or a pattern of apertures, if any, that are cut through the coated abrasive.

In another embodiment, the composite backing can be first cut into discs and then coated with binder, abrasive and size coat.

In another embodiment, the backing can be selectively coated with the binder to leave uncoated regions that are then coated with abrasive grains to form the abrasive areas. For example, the binder can be printed onto the backing, such as by screen printing, offset printing, rotary printing, or flexographic printing. In another example, the binder can be selectively coated using gravure coating, slot die coating, masked spray coating, or the like. Alternatively, a photoresist or UV curable mask can be applied to the backing and developed, such as by photolithography, to mask portions of the backing. In another example, a dewetting compound can be applied to the backing prior to applying the binder.

The Examples below illustrate the benefits of the present embodiments.

Example 1

Coated Abrasive Samples

Inventive coated abrasive samples S1 to S10 and comparative samples C1 and C2 were constructed as described in Table 1:

TABLE 1

| Sample | Backing material | Abrasive Grains | Make Wt. | Grain Wt. | Filler[5] (%) | Performance (%) |
|---|---|---|---|---|---|---|
| S1 | Polymer film[1] | BFRPL[2] | 0.95 | 1.82 | 0 | 102 |
| S2 | Polymer film[1] | SG:BFRPL (1:3)[3] | 1.02 | 2.37 | 0 | 120 |
| S3 | Polymer film[1] | SG:BFRPL:SiC (2:3:3)[4] | 0.88 | 1.27 | 0 | 127 |
| S4 | Polymer film[1] | SG:BFRPL (1:3)[3] | 0.88 | 1.82 | 10 | 84 |
| S5 | Polymer film[1] | SG:BFRPL:SiC (2:3:3)[4] | 0.95 | 2.37 | 10 | 109 |
| S6 | Polymer film[1] | BFRPL[2] | 1.02 | 1.27 | 10 | 111 |
| S7 | Polymer film[1] | SG:BFRPL:SiC (2:3:3)[4] | 1.02 | 1.82 | 19 | 123 |
| S8 | Polymer film[1] | BFRPL[2] | 0.88 | 2.37 | 19 | 102 |
| S9 | Polymer film[1] | SG:BFRPL (1:3)[3] | 0.95 | 1.27 | 19 | 111 |
| S10 | Polymer film[1] | SG:BFRPL (1:3)[3] | 0.95 | 1.82 | 0 | 108 |
| C1 | Paper[6] | BFRPL[2] | 0.95 | 1.82 | 0 | 100 |
| C2 | Paper[7] | SG:BFRPL (1:3)[3] | 0.95 | 1.82 | 0 | 100 |

[1]PET film (3 mil) bottom layer, Polyurethane primer, Surlyn 1652 top layer (1 mil), corona treated to 53 dyne/cm$^2$
[2]P600 Blue fired, semi friable aluminum oxide ("BFRPL") (Alodure brand,
[3]P600 Grain blend - Sol Gel Aluminum Oxide ("SG") (SG brand Saint-Gobain) and BFRPL, ratio 1:3
[4]P600 Grain blend - SG, BFRPL, and Silicon Carbide ("SiC"), ratio 2:3:3
[5]Wollastonite
[6]A275 paper backing treated w/ wetting agent
[7]A975 paper backing treated w/ wetting agent The inventive sample backing was a 3 mil PET film primed with a polyurethane layer and having a top layer of _. The backing was corona treated and had a surface energy of 53 dyne/cm$^2$. The make coat was a urea formaldehyde polymer binder composition. The abrasive grains, whether 100% BFRPL or a grain blend as indicated in the table, were grit size P600 and were applied to the make coat using a single pass. The make coat was cured to form the coated abrasives. Comparative samples C1 and C2 used paper backing that had been treated with a wetting agent (Astrowet®). The comparative samples used the same make coat composition as the inventive samples.

Example 2

Abrasive Performance Testing

Abrasive performance testing of the inventive and comparative coated abrasive articles was conducted. The coated abrasive samples were used to abrade acrylic test panels. The abrasive performance (total material removed from the workpiece surface) for each of the samples was recorded and as shown in FIG. 3 as a percentage of the control samples C1 and C2, which both have the same abrasive performance.

Figure 3:
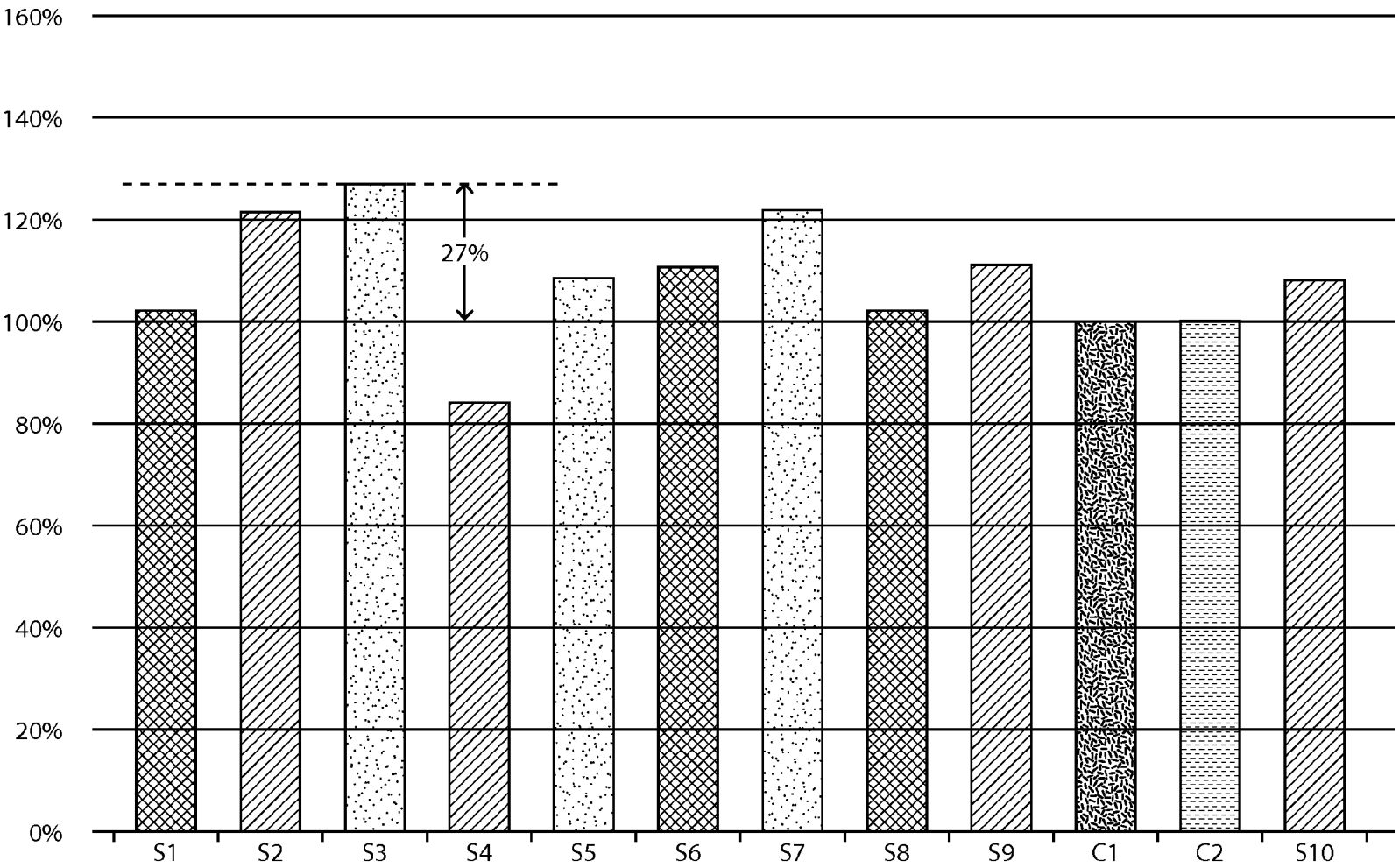
FIG. 3 is a bar graph illustrating improved abrasive performance of coated abrasive articles that include an abrasive particle blend in accordance with embodiments described herein compared to standard coated abrasive articles.

As shown in FIG. 3, inventive samples S3 and S7, both of which include a grain blend of 3 pluralities of abrasive grains, specifically seeded-gel aluminum oxide, blue fired heat treated semi-friable aluminum oxide "BFRPL"), and silicon carbide (SiC) in a ratio of 2:3:3, respectively, produced the highest abrasive performance. Inventive sample S3 performed the best and had a 27% increase over comparative samples C1 and C2. Inventive sample S7 had a 23% increase in abrasive performance over comparative samples C1 and C2.

Applicants also point out that the abrasive performance advantage of the three-type grain blend can be superior to the two-type grain blend, which is generally better than a single type grain. Comparison of samples S7 and S10 show that sample S7 had an approximate increased performance of 15% over sample S10. The increased performance is believed to be primarily due to the presence of the additional abrasive grain in the blend. Similarly, sample S3 showed an improved performance over sample S9, of 26% which is believed to be due primarily to the triple grain blend.

Item Category 1.

Item 1. An abrasive article comprising:

a backing material; and an abrasive layer disposed on the backing material, wherein the abrasive layer comprises a blend of abrasive particles comprising a first plurality of abrasive particles and a second plurality of abrasive particles.

Item 2. The abrasive article of item 1, wherein the blend of abrasive particles further comprises a third plurality of abrasive particles.

Item 3. The abrasive article of item 1, wherein the first plurality of abrasive particles comprises sol gel aluminum oxide abrasive particles, and the second plurality of abrasive particles comprises semi-friable aluminum oxide particles.

Item 4. The article of item 1, wherein the first plurality of abrasive particles and the second plurality of abrasive particles are present at a ratio of 1:3

Item 5. The abrasive article of item 2, wherein the first plurality of abrasive particles, the second plurality of abrasive particles, and the third plurality of abrasive particles are present at a ratio of 2:3:3.

Item 6. The abrasive article of item 2, wherein first plurality of abrasive particles comprises sol gel aluminum oxide abrasive particles, the second plurality of abrasive articles comprises semi-friable aluminum oxide particles, and the third plurality of abrasive particles comprises silicon carbide abrasive particles.

Item 7. The abrasive article of item 1, wherein the backing material comprises a polymer film.

Item 8. The abrasive article of item 7, wherein the polymer film is a PET film.

Item 9. The abrasive article of item 1, wherein the backing material comprises a laminate polymer film.

Item 10. The abrasive article of item 9, wherein the laminate polymer film has a top layer comprising an ionomer.

Item 11. The abrasive article of item 10, wherein the ionomer comprises an ethylene/methacrylic Acid (E/MAA) copolymer.

Item 12. The abrasive article of item 1, wherein the backing material has a surface energy of at least 50 dynes/cm$^2$.

Item 13. The abrasive article of item 1, wherein the backing material is corona treated.

Item 14. The abrasive article of item 1, wherein the backing material comprises a primer layer.

Item 15. A method of making a coated abrasive article comprising:

disposing an abrasive layer on a backing material, wherein the abrasive layer comprises a blend of abrasive particles comprising a first plurality of abrasive particles and a second plurality of abrasive particles.

Item Category 2.

Item 1. A coated abrasive article comprising an abrasive blend, the abrasive blend comprising:

a. up to 99 wt. % of a first plurality of abrasive grains selected from the group consisting of silicon carbide, garnet, cubic boron nitride, diamond, superabrasives, and aggregates, agglomerates and mixtures thereof, based on a total weight of the abrasive blend; and b. at least 1 wt. % of a second plurality of abrasive grains including at least one member selected from the group consisting of blue fired heat treated semi-friable aluminum oxide, silicon carbide, seeded gel aluminum oxide, garnet, cubic boron nitride, diamond, superabrasives, sintered sol-gel alumina, aluminum oxide and alloys of aluminum oxide, and aggregates, agglomerates and mixtures thereof, based on a total weight of the abrasive blend, wherein the first plurality of abrasive grains and the second plurality of abrasive grains are different from one another.

Item 2. The coated abrasive article of item 1, wherein the abrasive blend has a weighted average density not more than about 4.75 g/cm$^3$, such as not more than about 4.7 g/cm$^3$, not more than about 4.6 g/cm$^3$, not more than about 4.5 g/cm$^3$, not more than about 4.4 g/cm$^3$, not more than about 4.3 g/cm$^3$, not more than about 4.2 g/cm$^3$, not more than about 4.1 g/cm$^3$, not more than about 4.0 g/cm$^3$, not more than about 3.9 g/cm$^3$, not more than about 3.8 g/cm$^3$, not more than about 3.7 g/cm$^3$, not more than about 3.6 g/cm$^3$, or not more than about 3.5 g/cm$^3$.

Item 3. The coated abrasive article of item 1, wherein the abrasive blend has a weighted average density of at least about 2.5 g/cm$^3$, such as at least about 2.75 g/cm$^3$, at least about 2.85 g/cm$^3$, at least about 3.0 g/cm$^3$, at least about 3.15 g/cm$^3$, at least about 3.2 g/cm$^3$, at least about 3.3 g/cm$^3$, at least about 3.4 g/cm$^3$, at least about 3.5 g/cm$^3$, at least about 3.6 g/cm$^3$, at least about 3.65 g/cm$^3$, at least about 3.7 g/cm$^3$, at least about 3.75 g/cm$^3$, or at least about 3.8 g/cm$^3$.

Item 4. The coated abrasive article according to any one of items 1, 2 or 3, wherein the abrasive blend has a weighted average Moh's hardness of at least about 6, such as at least about 6.2, at least about 6.4, at least about 6.6, at least about 6.8, at least about 7.0, at least about 7.10, at least about 7.25, at least about 7.35, at least about 7.45, at least about 7.5, at least about 7.6, at least about 7.7, at least about 7.8, at least about 7.9, or at least about 8.0.

Item 5. The coated abrasive article according to any one of items 1, 2 or 3, wherein the abrasive blend has a weighted average Moh's hardness of less than about 10, such as less than about 9.9, less than about 9.8, less than about 9.7, less than about 9.6, less than about 9.5, less than about 9.4, less than about 9.25, less than about 9.1, less than about 9, less than about 8.9, less than about 8.8, less than about 8.75, less than about 8.6, less than about 8.5, less than about 8.4, or less than about 8.3.

Item 6. The coated abrasive article according to any one of items 1, 2 or 3, wherein the abrasive blend has a weighted average Knoop hardness value of at least about 1000, such at least about 1550, at least about 1600, at least about 1625, at least about 1650, at least about 1700, at least about 1750, at least about 1800, at least about 2000, at least about 2250, at least about 2400, at least about 2600, at least about 3000, at least about 3250, at least about 3750, at least about 4000, at least about 4500, at least about 5000, at least about 5500, or at least about 6000.

Item 7. The coated abrasive article according to any one of items 1, 2 or 3, wherein the abrasive blend has a weighted average Knoop hardness value of less than about 8000, such at less than about 7750, less than about 7500, less than about 7000, less than about 6750, less than about 6500, less than about 6250, less than about 6000, less than about 5750, less than about 5500 or less than about 5250.

Item 8. The coated abrasive article of item 1, wherein the first plurality of abrasive grains includes seeded-gel aluminum oxide and the second plurality of abrasive grains includes silicon carbide.

Item 9. The coated abrasive article of item 1, wherein the abrasive blend comprises a grain ratio between the first plurality of abrasive grains and the second plurality of abrasive grains ranging from 1:10, such as from 1:9, from 1:8, from 1:7, from 1:6, from 1:5, from 1:4, from 1:3, from 1:2, or from 1:1.

Item 10. The coated abrasive article of item 1, wherein the abrasive blend comprises a grain ratio between the first abrasive plurality of abrasive grains and the second abrasive plurality of abrasive grains ranging from 10:1, such as from 9:1, from 8:1, from 7:1, from 6:1, from 5:1, from 4:1, from 3:1, from 2:1 or from 1:1.

Item 11. The coated abrasive article of item 1, wherein the abrasive blend further comprises:

c. a third plurality of abrasive grains.

Item 12. The coated abrasive article of item 11, wherein the abrasive blend further comprises:

d. a fourth plurality of abrasive grains.

Item 13. The coated abrasive article of item 11, wherein the first plurality of abrasive grains, the second plurality of abrasive grains, and the third plurality of abrasive grains are each different from each other.

Item 14. The coated abrasive article of item 12, wherein the first plurality of abrasive grains, the second plurality of abrasive grains, the third plurality of abrasive grains, and the fourth plurality of abrasive grains are each different from each other.

Item 15. The coated abrasive article of any one of items 1, 11 or 12, wherein the abrasive blend further comprises a diluent.

Item 16. The coated abrasive article of item 15, wherein the diluent comprises an inactive abrasive filler.

Item 17. The coated abrasive article of item 15, wherein the diluent includes an active abrasive filler.

Item 18. The coated abrasive article of item 16, wherein the abrasive blend further comprises an active abrasive filler.

Item 19. The coated abrasive article of item 15, wherein the diluent is present in an amount of no greater than approximately 95% by weight based on a total weight of the abrasive blend, such as no greater than approximately 92% by weight, no greater than approximately 90% by weight, no greater than approximately 88% by weight, no greater than approximately 86% by weight, no greater than approximately 84% by weight, no greater than approximately 82% by weight, no greater than approximately 80% by weight, no greater than approximately 78% by weight, no greater than approximately 76% by weight, no greater than approximately 74% by weight, no greater than approximately 72% by weight, no greater than approximately 70% by weight, no greater than approximately 68% by weight, no greater than approximately 66% by weight, no greater than approximately 64% by weight, or no greater than approximately 60% by weight, based on a total weight of the abrasive blend.

Item 20. The coated abrasive article of item 15, wherein the diluent is present in an amount of at least approximately 1% by weight, based on a total weight of the abrasive blend, such as at least approximately 2% by weight, at least approximately 4% by weight, at least approximately %% by weight, at least approximately 7% by weight, at least approximately 10% by weight, at least approximately 12% by weight, at least approximately 15% by weight, at least approximately 18% by weight, at least approximately 20% by weight, at least approximately 25% by weight, at least approximately 28% by weight, at least approximately 30% by weight, at least approximately 32% by weight, at least approximately 35% by weight, at least approximately 38% by weight, at least approximately 40% by weight, at least approximately 42% by weight, at least approximately 45% by weight, at least approximately 48% by weight, or at least approximately 50% by weight, based on a total weight of the abrasive blend.

Item 21. The coated abrasive article of item 16, wherein the inactive abrasive filler is at least one member selected from the group consisting of gypsum, cadmium, quartz, limestone, apatite, magnesia, calcite, zinc, copper, and combinations thereof.

Item 22. The coated abrasive article of item 17, wherein the active abrasive filler is at least one member selected from the group consisting of halogenated polymers, halide salts, phosphates, carbonates, bi-carbonates, metal salts of organic compounds, halide salts of organic compounds, sulfur and sulfur-containing compounds, and combinations thereof.

Item 23. The coated abrasive article of item 1, wherein the abrasive blend comprises a cumulative cut that is at least 10% greater than a cumulative cut of a comparative abrasive sample, such as at least 20% greater, at least 25% greater or at least 30% greater.

Item 24. The coated abrasive article of item 23, wherein the comparative abrasive sample consists of blue fired heat treated semi-friable aluminum oxide prepared in a similar manner to the abrasive blend.

Item 25. The coated abrasive article of claim 11, wherein the abrasive blend comprises a grain ratio between the first plurality of abrasive grains, the second plurality of abrasive grains, and the third plurality of abrasive grains of from 1:5:10, and all values between, such as from 1:5:9, from 1:5:8, from 1:5:7, from 1:2:10, from 1:3:10, from 1:4:10, from 1:5:10, from 1:6:10, from 1:7:10, from 2:5:10 from 2:5:9, from 2:4:8, from 2:4:7, from 2:5:7, from 3:5:10, from 3:5:9, from 3:5:7, from 3:5:7, from 3:5:5, from 1:3:3, from 1:2:3, from 1:1:10, from 1:1:5, from 1:1:2, from 1:1:1, or from 2:2:5.

Item 26. The coated abrasive article of item 1, further comprising Kevlar pulp.

Item 27. The coated abrasive article of any one of items 1, 11 or 12 further comprising a backing material.

Item 28. The coated abrasive article of item 27, wherein the abrasive blend is uniformly distributed across a surface of the backing material across an x/y plane.

Item 29. The coated abrasive article of item 27, wherein the abrasive blend is non-uniformly distributed across a surface of the backing material across an x/y plane.

Item 30. The coated abrasive article of item 29, wherein the backing material comprises a different content of the abrasive blend at a peripheral region of the backing material as compared to a central region of the backing material.

Item 31. The coated abrasive article of item 27, wherein least 25% of a surface area of the backing material is coated with the abrasive blend, such as at least 30%, at least 35%, at least 40%, at least 50%, at least 55%, at least 60%, at least 65%, at least 70% or at least 75% of a surface area of the backing material.

Item 32. The coated abrasive article of any one of items 1, 2, 3, 11 or 12, wherein the first plurality of abrasive grains is uniformly dispersed throughout the abrasive blend.

Item 33. The coated abrasive article of any one of items 1, 2, 3, 11 or 12, wherein the second plurality of abrasive grains is uniformly dispersed throughout the abrasive blend.

Item 34. The coated abrasive article of item 11, wherein the third plurality of abrasive grains is uniformly dispersed throughout the abrasive blend.

Item 35. The coated abrasive article of item 11, wherein the third plurality of abrasive grains is non-uniformly dispersed throughout the abrasive blend.

Item 36. The coated abrasive article of item 12, wherein the fourth plurality of abrasive grains is uniformly dispersed throughout the abrasive blend.

Item 37. The coated abrasive article of item 12, wherein the fourth plurality of abrasive grains is non-uniformly dispersed throughout the abrasive blend.

Item 38. A coated abrasive product comprising the coated abrasive article of any one of items 1, 11 or 12, wherein the product is selected from the group consisting of sanding belts, discs, rolls, cartridge rolls, slotted discs, flap discs, cones, flap discs, flap wheels, cross pads, square pads, spiral bands, hand pads, sheets and belts.

Item 39. The coated abrasive article of any one of items 1, 11 or 12, further comprising a backing material and wherein the first plurality of abrasive grains and the second plurality of abrasive grains comprise abrasive agglomerate grains adhered to the backing by a binder material, wherein the agglomerate grains used comprise a plurality of abrasive particles adhered together in a three dimensional structure in which each particle is joined to at least one adjacent particle by a particle binder material which is present in the agglomerate as a discontinuous phase located essentially completely in the form of bond posts within the agglomerate grain.

Item 40. The coated abrasive article of any one of items 1, 11 or 12, further comprising a supersize layer comprising stearate, and wherein the first plurality of abrasive grains includes silicon carbide, and the second plurality of abrasive grains comprises seeded gel aluminum oxide.

As used herein, the terms "comprises," "comprising," "includes," "including," "has," "having," or any other variation thereof, are intended to cover a non-exclusive inclusion. For example, a process, method, article, or apparatus that comprises a list of features is not necessarily limited only to those features but can include other features not expressly listed or inherent to such process, method, article, or apparatus. As used herein, the phrase "consists essentially of" or "consisting essentially of" means that the subject that the phrase describes does not include any other components that substantially affect the property of the subject.

Further, unless expressly stated to the contrary, "or" refers to an inclusive-or and not to an exclusive-or. For example, a condition A or B is satisfied by any one of the following: A is true (or present) and B is false (or not present), A is false (or not present) and B is true (or present), and both A and B are true (or present).

The use of "a" or "an" is employed to describe elements and components described herein. This is done merely for convenience and to give a general sense of the scope of the invention. This description should be read to include one or at least one and the singular also includes the plural, or vice versa, unless it is clear that it is meant otherwise.

Further, references to values stated in ranges include each and every value within that range. When the terms "about" or "approximately" precede a numerical value, such as when describing a numerical range, it is intended that the exact numerical value is also included. For example, a numerical range beginning at "about 25" is intended to also include a range that begins at exactly 25.

As used herein, the phrase "average particle diameter" can be reference to an average, mean, or median particle diameter, also commonly referred to in the art as D50.

Unless otherwise defined, all technical and scientific terms used herein have the same meaning as commonly understood by one of ordinary skill in the art to which this invention belongs. The materials, methods, and examples are illustrative only and not intended to be limiting. To the extent not described herein, many details regarding specific materials and processing acts are conventional and can be found in textbooks and other sources within the scintillation and radiation detection arts.

In the foregoing, reference to specific embodiments and the connections of certain components is illustrative. It will be appreciated that reference to components as being coupled or connected is intended to disclose either direct connection between said components or indirect connection through one or more intervening components as will be appreciated to carry out the methods as discussed herein. As such, the above-disclosed subject matter is to be considered illustrative, and not restrictive, and the appended claims are intended to cover all such modifications, enhancements, and other embodiments, which fall within the true scope of the present invention. Moreover, not all of the activities described above in the general description or the examples are required, that a portion of a specific activity can not be required, and that one or more further activities can be performed in addition to those described. Still further, the order in which activities are listed is not necessarily the order in which they are performed.

The disclosure is submitted with the understanding that it will not be used to interpret or limit the scope or meaning of the claims. In addition, in the foregoing disclosure, certain features that are, for clarity, described herein in the context of separate embodiments, can also be provided in combination in a single embodiment. Conversely, various features that are, for brevity, described in the context of a single embodiment, can also be provided separately or in any subcombination. Still, inventive subject matter can be directed to less than all features of any of the disclosed embodiments.

Benefits, other advantages, and solutions to problems have been described above with regard to specific embodiments. However, the benefits, advantages, solutions to problems, and any feature(s) that can cause any benefit, advantage, or solution to occur or become more pronounced are not to be construed as a critical, required, or essential feature of any or all the claims.

Thus, to the maximum extent allowed by law, the scope of the present invention is to be determined by the broadest permissible interpretation of the following claims and their equivalents, and shall not be restricted or limited by the foregoing detailed description.

What is claimed is:

1. An abrasive article comprising:

a backing material; and an abrasive layer disposed on the backing material, wherein the abrasive layer comprises a blend of abrasive particles comprising a first plurality of abrasive particles and a second plurality of abrasive particles, wherein the backing material comprises a laminate polymer film, and wherein the laminate polymer film has a top layer comprising an ionomer.

2. The abrasive article of claim 1, wherein the blend of abrasive particles further comprises a third plurality of abrasive particles.

3. The abrasive article of claim 1, wherein the first plurality of abrasive particles comprises sol gel aluminum oxide abrasive particles, and the second plurality of abrasive particles comprises semi-friable aluminum oxide particles.

4. The article of claim 1, wherein the first plurality of abrasive particles and the second plurality of abrasive particles are present at a ratio of 1:3.

5. The abrasive article of claim 2, wherein the first plurality of abrasive particles, the second plurality of abrasive particles, and the third plurality of abrasive particles are present at a ratio of 2:3:3.

6. The abrasive article of claim 2, wherein first plurality of abrasive particles comprises sol gel aluminum oxide abrasive particles, the second plurality of abrasive articles comprises semi-friable aluminum oxide particles, and the third plurality of abrasive particles comprises silicon carbide abrasive particles.

7. The abrasive article of claim 1, wherein the polymer film is a PET film.

8. The abrasive article of claim 1, wherein the laminate polymer film has a top layer comprising an ionomer.

9. The abrasive article of claim 8, wherein the ionomer comprises an ethylene/methacrylic Acid (E/MAA) copolymer.

10. The abrasive article of claim 1, wherein the backing material has a surface energy of at least 50 dynes/$cm^2$.

11. The abrasive article of claim 1, wherein the backing material is corona treated.

12. The abrasive article of claim 1, wherein the backing material comprises a primer layer.

13. An abrasive article comprising:

a backing material; and an abrasive layer disposed on the backing material, wherein the abrasive layer comprises a blend of abrasive particles comprising a first plurality of abrasive particles and a second plurality of abrasive particles, and wherein the first plurality of abrasive particles comprises sol gel aluminum oxide abrasive particles, and the second plurality of abrasive particles comprises semi-friable aluminum oxide particles.

14. An abrasive article comprising:

a backing material; and an abrasive layer disposed on the backing material, wherein the abrasive layer comprises a blend of abrasive particles comprising a first plurality of abrasive particles, a second plurality of abrasive particles, and a third plurality of abrasive particles, and wherein first plurality of abrasive particles comprises sol gel aluminum oxide abrasive particles, the second plurality of abrasive articles comprises semi-friable aluminum oxide particles, and the third plurality of abrasive particles comprises silicon carbide abrasive particles.

15. An abrasive article comprising:

a backing material; and an abrasive layer disposed on the backing material, wherein the abrasive layer comprises a blend of abrasive particles comprising a first plurality of abrasive particles and a second plurality of abrasive particles, and wherein the first plurality of abrasive particles and the second plurality of abrasive particles are present at a ratio of 1:3.

16. The abrasive article of claim 15, wherein at least one of the pluralities of abrasive particles comprises sol gel aluminum oxide abrasive particles or semi-friable aluminum oxide particles.

17. The abrasive article of claim 15, wherein the first plurality of abrasive particles comprises sol gel aluminum oxide abrasive particles and the second plurality of abrasive particles comprises semi-friable aluminum oxide particles.

18. An abrasive article comprising:

a backing material; and an abrasive layer disposed on the backing material, wherein the abrasive layer comprises a blend of abrasive particles comprising a first plurality of abrasive particles, a second plurality of abrasive particles, and a third plurality of abrasive particles, and wherein the first plurality of abrasive particles, the second plurality of abrasive particles, and the third plurality of abrasive particles are present at a ratio of 2:3:3.

19. The abrasive article of claim 18, wherein at least one of the pluralities of abrasive particles comprises sol gel aluminum oxide abrasive particles, semi-friable aluminum oxide abrasive particles, or silicon carbide abrasive particles.

20. The abrasive article of claim 18, wherein the first plurality of abrasive particles comprises sol gel aluminum oxide abrasive particles, the second plurality of abrasive articles comprises semi-friable aluminum oxide particles, and the third plurality of abrasive particles comprises silicon carbide abrasive particles.

* * * * *